US007116789B2

(12) United States Patent
Layton et al.

(10) Patent No.: US 7,116,789 B2
(45) Date of Patent: Oct. 3, 2006

(54) SONIC LANDSCAPE SYSTEM

(75) Inventors: Leonard Layton, Ultimo (AU); David Stanley McGrath, Ultimo (AU); Nigel Lloyd William Heyler, Ultimo (AU); Stephen James Bennett, Ultimo (AU); Richard James Cartwright, Ultimo (AU); Geoffrey Alexander Drane, Ultimo (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 405 days.

(21) Appl. No.: 10/206,273

(22) Filed: Jul. 26, 2002

(65) Prior Publication Data

US 2003/0031334 A1 Feb. 13, 2003

Related U.S. Application Data

(63) Continuation of application No. PCT/AU01/00079, filed on Jan. 29, 2001.

(51) Int. Cl.
*H04R 5/00* (2006.01)

(52) U.S. Cl. ..... 381/17; 381/310

(58) Field of Classification Search ..... 381/17, 381/77–82, 310

See application file for complete search history.

(56) References Cited

U.S. PATENT DOCUMENTS 5,438,623 A 8/1995 Begault
5,691,737 A * 11/1997 Ito et al. ..... 345/8
5,717,392 A * 2/1998 Eldridge ..... 340/996
5,796,351 A * 8/1998 Yabuki ..... 340/825.69
5,797,125 A * 8/1998 Hirohama ..... 704/277
5,926,400 A 7/1999 Kytle et al.
5,943,427 A 8/1999 Massie et al.
5,987,142 A * 11/1999 Courneau et al. ..... 381/17
6,021,206 A 2/2000 McGrath
6,122,520 A 9/2000 Want et al.

(Continued)

FOREIGN PATENT DOCUMENTS

JP 11-3280771 11/1999

(Continued)

OTHER PUBLICATIONS

Sawhaney, N. et al., "Nomadic Radio: A Spatialized Audio Environment for Wearable Computing," International Symposium on Wearable Computing, MIT Media Laboratory, Speech Interface Group, Oct. 13-14, 1997, 2 pgs., Cambridge, MA.

*Primary Examiner*—Brian T. Pendleton
(74) *Attorney, Agent, or Firm*—Dov Rosenfeld; Inventek

(57) ABSTRACT

A system for providing a listener with an augmented audio reality in a geographical environment said system comprising a position locating system for determining a current position and orientation of a listener in said geographical environment; an audio track creation system for creating an audio track having a predetermined spatialization component dependent on an apparent location of an apparent source associated with said audio track in said geographical environment; an audio track rendering system adapted to render an audio signal based on said audio track to a series of speakers surrounding said listener such that said listener experiences an apparent preservation of said spatialization component; and an audio track playback system interconnected to said position locating system and said audio track creation system and adapted to forward a predetermined audio track to said audio rendering system for rendering depending on said current position and orientation of said listener in said geographical environment.

10 Claims, 7 Drawing Sheets

U.S. PATENT DOCUMENTS

| | | | | |
|---|---|---|---|---|
| 6,647,119 | B1 * | 11/2003 | Slezak | 381/17 |
| 2002/0052684 | A1 * | 5/2002 | Bide | 701/200 |
| 2002/0091793 | A1 * | 7/2002 | Sagie | 709/217 |
| 2004/0110515 | A1 * | 6/2004 | Blumberg et al. | 455/456.1 |

FOREIGN PATENT DOCUMENTS

| | | |
|---|---|---|
| WO | WO 99/41880 | 8/1999 |
| WO | WO 99/51063 | 10/1999 |

* cited by examiner

SONIC LANDSCAPE SYSTEM

This application is a continuation of co-pending international application number PCT/AU01/00079, filed Jan. 29, 2001.

FIELD OF THE INVENTION

The present invention relates to the field of immersive audio environments and, in particular discloses an immersive environment utilising adaptive tracking capabilities.

BACKGROUND OF THE INVENTION

Humans and other animals have evolved to take in and process audio information in their environment so as to derive information from that environment. Hence, our ears have evolved to an extremely complex level to enable us to track accurately the position of an audio source around us.

Further, the provision of audio information is also a highly efficient form of information provision to humans. This is especially the case in the tourism industry where the provision of audio dialogue describing scenery is quite common.

SUMMARY OF THE INVENTION

In accordance with a first aspect of the present invention, there is provided a system for providing a listener with an augmented audio reality in a geographical environment said system comprising a position locating system for determining a current position and orientation of a listener in said geographical environment; an audio track creation system for creating an audio track having a predetermined spatialization component dependent on an apparent location of an apparent source associated with said audio track in said geographical environment; an audio track rendering system adapted to render an audio signal based on said audio track to a series of speakers surrounding said listener such that said listener experiences an apparent preservation of said spatialization component; and an audio track playback system interconnected to said position locating system and said audio track creation system and adapted to forward a predetermined audio track to said audio rendering system for rendering depending on said current position and orientation of said listener in said geographical environment.

In one embodiment, said system is arranged, in use, to simultaneously provide an augmented audio reality to multiple listeners located in said geographical environment.

Preferably, said speakers comprise a set of headphones.

Advantageously, the position locating system is arranged, in use, to determine the listener's head orientation as said current orientation of the listener in said geographical environment.

In one embodiment, said geographical environment comprises one of tourism, outdoor sight seeing, museum tours, a mobility aid for the blind and in industrial applications, artistic performances, Indoor Exhibition Spaces, Outdoor Exhibition spaces, Tours, Exhibition, City Tours, both guided and self-guided, Botanical Gardens, Zoos, Aquariums, Entertainment, Themeparks, Interactive theme environments, VR Games, Construction, auditory display of data such as plans or existing structures below ground, Architectural on-site walk throughs.

Preferably, said position locating system comprises at least one of a compass, a global positioning system, a radio frequency positioning system or an electromagnetic wave positioning.

Advantageously, the audio track creation system further comprises an audio customization unit for customizing an audio content of said audio track dependent on an identity of said listener.

In one embodiment, the audio track creation system further comprises a computer network attached to said audio customization unit for downloading said audio content.

Preferably, the system further comprises a feedback unit interconnected to said audio customization unit, for monitoring the listener's feedback in response to said audio content.

Advantageously, said computer network comprises audio content indexed by geographical location.

In one embodiment, said computer network comprises textual content indexed by geographical location and said audio customization unit comprises a text to audio rendering unit for rendering said text into audio.

Preferably, said feedback unit includes a microphone for monitoring said listening audio environment.

Advantageously, said microphone provides spatialization characteristics of audio signals in said listener's audio environment.

In one embodiment, said audio customization unit comprises at least one personality control unit, customizing said audio content with a personality feature having predetermined characteristics.

Preferably, audio customization unit is adapted to send a series of information requests containing geographical indicators to said network, and receive therefrom a series of responses containing geographical indicators for rendering to said listener.

Advantageously, said audio customization unit of a first listener is adapted to interact with the audio customization units of one or more other listeners so as to exchange information.

In one embodiment, the system is arranged, in use, such that said exchange of information is dependent on the particular listener with whom an exchange is made.

Preferably, said computer network comprises a series of portals answering requests for information by said audio customization unit.

Advantageously, wherein said audio portals comprise personality customized information utilised in answering requests for information.

In accordance with a second aspect of the present invention, there is provided a method of providing a listener with an augmented audio reality in a geographical environment, the method comprising the steps of determining a current position and orientation of a listener in said geographical environment; creating an audio track having a predetermined spatialization component dependent on an apparent location of an apparent source associated with said audio track in said geographical environment; rendering an audio signal based on said audio track to a series of speakers surrounding said listener such that said listener experiences an apparent preservation of said spatialization component, wherein the rendering depends on said current position and orientation of said listener in said geographical environment.

In one embodiment, the method comprises simultaneously providing an augmented audio reality to multiple listeners located in said geographical environment.

Preferably, said speakers comprise a set of headphones.

Advantageously, the method comprises determining the listener's head orientation as said current orientation of the listener in said geographical environment.

In one embodiment, said geographical environment comprises one of tourism, outdoor sight seeing, museum tours, a mobility aid for the blind and in industrial applications, artistic performances, Indoor Exhibition Spaces, Outdoor Exhibition spaces, Tours, Exhibition, City Tours, both guided and self-guided, Botanical Gardens, Zoos, Aquariums, Entertainment, Themeparks, Interactive theme environments, VR Games, Construction, auditory display of data such as plans or existing structures below ground, Architectural on-site walk throughs.

Preferably, the method further comprises the step of customizing an audio content of said audio track dependent on an identity of said listener.

Advantageously, the method further comprises the step of downloading said audio content from a computer network.

In one embodiment, the method further comprises the step of monitoring the listener's feedback in response to said audio content.

Preferably, said computer network comprises audio content indexed by geographical location.

Advantageously, said computer network comprises textual content indexed by geographical location and the method further comprises text to audio rendering unit for rendering said text into audio.

BRIEF DESCRIPTION OF THE DRAWINGS

Preferred embodiments of the present invention will now be described by way of example only with reference to the accompanying drawings in which.

DESCRIPTION OF THE PREFERRED AND OTHER EMBODIMENTS

In the preferred embodiment, there is provided an immersive audio system which includes positional tracking information to allow for audio information to be personalised to each listener in the environment so they may be provided with an augmented reality.

Figure 1:
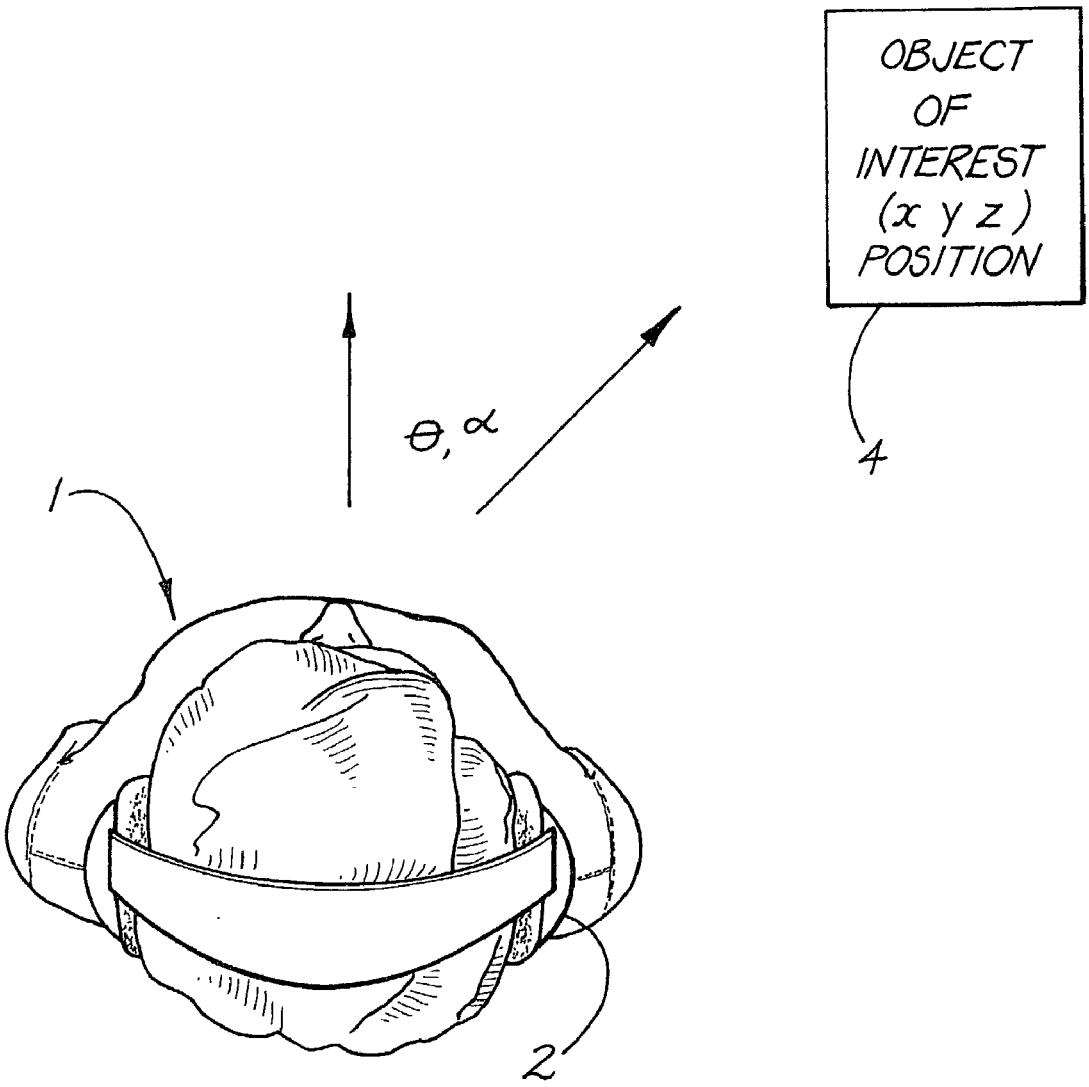
FIG. 1 illustrates schematically the locating of audio objects in a geographical space.

FIG. 1 provides an illustration of the operation of the preferred embodiment and includes a user or listener 1 in an environment. The listener is equipped with headphones 2, which, depending on the implementation details of the embodiment, can include a set of standard headphones and an associated audio processing unit, or, for example, a modified form of headphones suitably modified to include the significant DSP processing power required to implement the rendering process required in the preferred embodiment.

The augmented environment includes a series of objects of interest each of which has a spatial location and an associated audio track. For example, in a tourism type application, the objects of interest may be statues or places of interest in the listener's environment. In a gallery type environment the objects of interest might be paintings or sculptures etc. To the listener, the object appears to 'talk' to the listener 1. As will become more apparent hereinafter, the preferred embodiment includes an associated audio processing which renders the audio so that it appears to be coming from the spatial position of the object 4.

Figure 2:
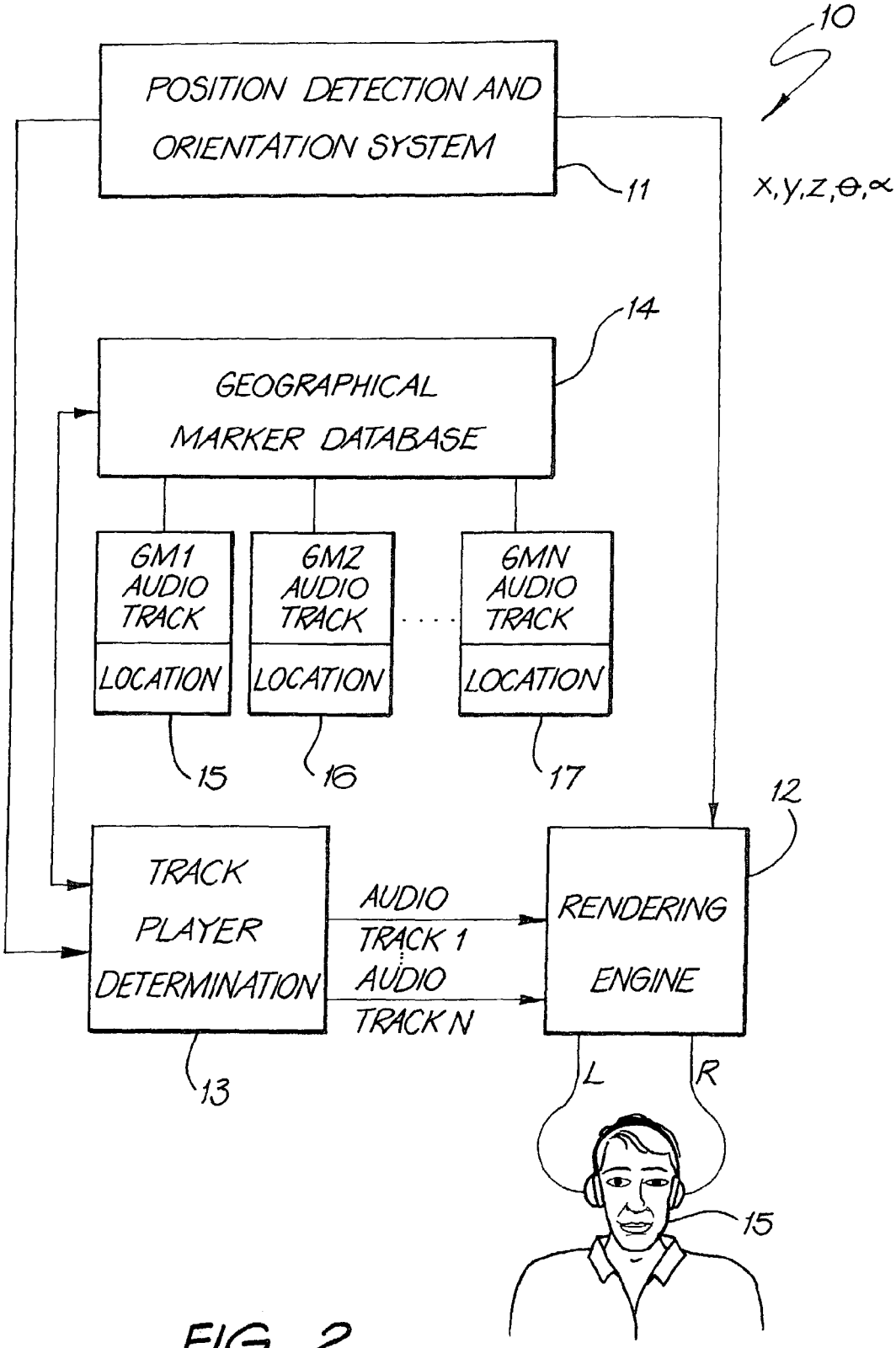
FIG. 2 illustrates schematically one form of the preferred embodiment.

Turning now to FIG. 2 there is illustrated one form of implementation of an embodiment 10. The preferred embodiment includes a position detection and orientation system 11 which locates the listener within a predetermined reference frame. The system 11 can take many different forms. For example, it can comprise a global positioning system locater to determine a current spatial location of a listener and an accelerometer device to determine a current orientation. The accelerometer can take the form of a Microelectromechanical system. Depending on the listeners environment, (for example, where the listener is located in a streetscape), in order to more accurately determine a likely current orientation of a listener, a velocity component of the listener can be determined from multiple measurements made over a period of time and, if the listener is moving at a walking pace then a weighting can be between a velocity vector of orientation and the accelerometer measurement. Further, as it is likely that a person is looking where they are going, the direction of travel can be used to modify the initial directional vector of the accelerometer. If however, the accelerometer is of high enough accuracy, such modifications may not be required. In an alternative arrangement, the earths magnetic field could be utilised to determine a current orientation.

The position detection and orientation system outputs a current position and location to a rendering engine 12 and a track player determination unit 13.

A geographical marker data base 14 is also provided which includes a series of audio tracks 15–17 with each audio track having associated location information signifying the location in the augmented environment in which the audio track should occur and from how far away it should be heard. The track player determination unit 13 utilises the current position information from the system 11 to determine suitable audio tracks to play around the current position of the listener 15. The output audio tracks are then output with associated location information to the rendering engine 12. The location information can comprise the relative location of the audio source relative to the listener 15.

The rendering system 12 renders each audio track given a current orientation of a listener so that it appears to come from the designated position.

The rendering system can take many forms. For example, U.S. Standard Application Ser. No. 08/893848 which claims priority from Australian Provisional Application Ser. No. PO0996, both the contents of which are specifically incorporated by cross reference, discloses a system for rendering a B-formatted sound source in a head tracked environment at a particular location relative to a listener. Hence, if the audio tracks are stored in a B-format then such a system, suitably adapted, can be used to render the audio tracks. One example of where such a system is suitable is where the B-format part of the rendering to be done centrally, and the headtracking part (which is applied to the B-format signal to generate headphone signal) is done locally. B-field calculation can be expensive and may be done centrally. However, central computation incurs communication delays, and this may have the effect of introducing latency in position. The headtracking can be done locally because this is very sensitive to latency.

Alternatively, Patent Cooperation Treaty Patent PCT/AU99/00242 discloses a system for Headtracked Processing for headtracked playback of audio and, in particular, in the presence of head movements. Such a system could be used as the rendering engine by rendering the audio track to a predetermined format (e.g. Dolby 5.1 channel surround) so as to have a predetermined location relative to a listener, and, in turn, utilising the system described in the PCT application to then provide for the localisation of an audio signal in the presence of head movements.

In the further alternative, Patent Cooperation Treaty Patent PCT/AU99/00002 discloses a system for rendering audio such as Dolby 5.1 channel surround to a listener over headphones with suitable computational modifications. By locating a sound around a listener utilising panning of the sound source between virtual speakers and subsequently rendering the speakers utilising the aforementioned disclosure, it is again possible to spatialise a sound source around a listener.

Obviously, other known techniques for spatialising sound over headphones could be utilised.

Ideally, the overall system is implemented in the form of a highly integrated Application Specific Integrated Circuit (ASIC) and associated memory so as to provide for an extremely compact implementation form. The resulting system allows the wearer to wander at will in space and experience a three dimensional acoustic simulation that is overlaid on the real physical space. The sounds heard can be from multiple sources that respond in volume and position as the person moves as if they were real and attached to the real world objects. The system can also include sonic objects that are not connected and have non physical range rolloff.

The system has many applications such as artistic performances, Indoor Exhibition Spaces, Outdoor Exhibition spaces, Tours, Exhibitions, City Tours, both guided and self-guided, Botanical Gardens, Zoos, Aquariums, Entertainment, Themeparks, Interactive theme environments, VR Games, Construction, auditory display of data such as plans, existing structures below ground, Architectural on-site walk throughs with interactive auditory display. "And over here there will be a large pink waterfall, tastefully decorated . . . " etc.

The system utilises the following elements: Listener position and orientation detection, Determination of time at location, and time since start, Selection, sequencing and streaming of relevant sound sources based on the listener position and time at position or time since start with respect to the sound source nominal location and time sequence, Rendering of the streamed sound sources to headphones, based on their range and orientation to the listener, Sound storage and recall, and processing hardware and obviously many variations in these technologies are possible.

Further, many different formats of implementation are possible in multi-listener environments. For example, in a centralised implementation all the listener positions can be acquired, sound processed and rendered centrally for each listener position then transmitted on a separate channel to each listener. In a distributed implementation a mobile processing station determines its position and locally processes and renders pre-recorded sound to the listener.

An example utilisation, attempting to provide a sense of its use is set out in the following example fictionalised use:

I am standing in the rue de Rivoli immediately south of the Marais Quartier in Paris. I am still aware of the busy street sound of the rue Rivoli behind me but now I hear a voice beckoning me from the entrance of a small side street—I turn to look but no—one is present—strangely the voice persists and as I walk towards the side street the voice dissolves into laughter and melts into the sound of running steps which disappear up the narrow street ahead of me. To my right a street door slams, some footsteps and I am greeted gruffly, the footsteps brush past and recede behind me—ahead I hear some music, children's voices and a horse's hooves walking across the pavé, I proceed. I arrive at the entrance to a small square, the music has grown much louder—a whistle to my left, apparently coming from a small Judas gate in the portal of the square, again a whistle—as I approach a voice begins to recount a story, at first in French, but then it is overlaid by a second voice speaking rather archaic English.

I am told to look up at the small statue that sits in a niche above the portal—I am quite dumbfounded—how can my simple headset know I am standing here? Anyway the voice starts into a complicated history concerning the statue which represents a poet—but I decide to move on. As I walk into the square the voice fades behind me and I enter an atmosphere of wheeled barrows being trundled over the cobbled surface and over to my left a child singing a rhyme.

(Now if I decided to stay motionless in this square the obvious options for the system would be that (a) the barrows repeat their trajectory and the child reiterates the rhyme ad nauseum (b) the system would recognize my continued presence and pick up another sequence). It is getting late, so I decide to head back to the exhibition centre—as I exit, passing via the square's portal once more I encounter a soothsayer laying out the cards of a Tarot reading—I hear the flick and fall of each card as it is placed on the table and then the slow but intense voice of the reader, describing the scene. Eventually when the sequence has been laid out the Tarot reading begins in earnest—taking me on a journey through an imaginary landscape, but it seems that as each of the places and characters are described I can hear their distant sounds, ghosting in the background. (So I have re-entered a mosaic coordinate and the system has recognized that we have been here before—and has automatically loaded afresh sound sequence for me).

As I approach the rue Rivoli bells begin to peal all over the city, it must be the approach of Evensong—on the pavement I slowly turn around, locating seven different sets of church bells, some proximate and some distant. At precisely 18.00 the bells fade and the evening traffic noise invades my headset—I press end programme and enter into the chaos of rush-hour.

It can therefore be seen that the system can overlay a virtual sound environment onto real world objects so as to use the system to inform or entertain a user. This allows for use in many fields such as tourism, outdoor sight seeing, museum tours, a mobility aid for the blind and in industrial applications.

Figure 3:
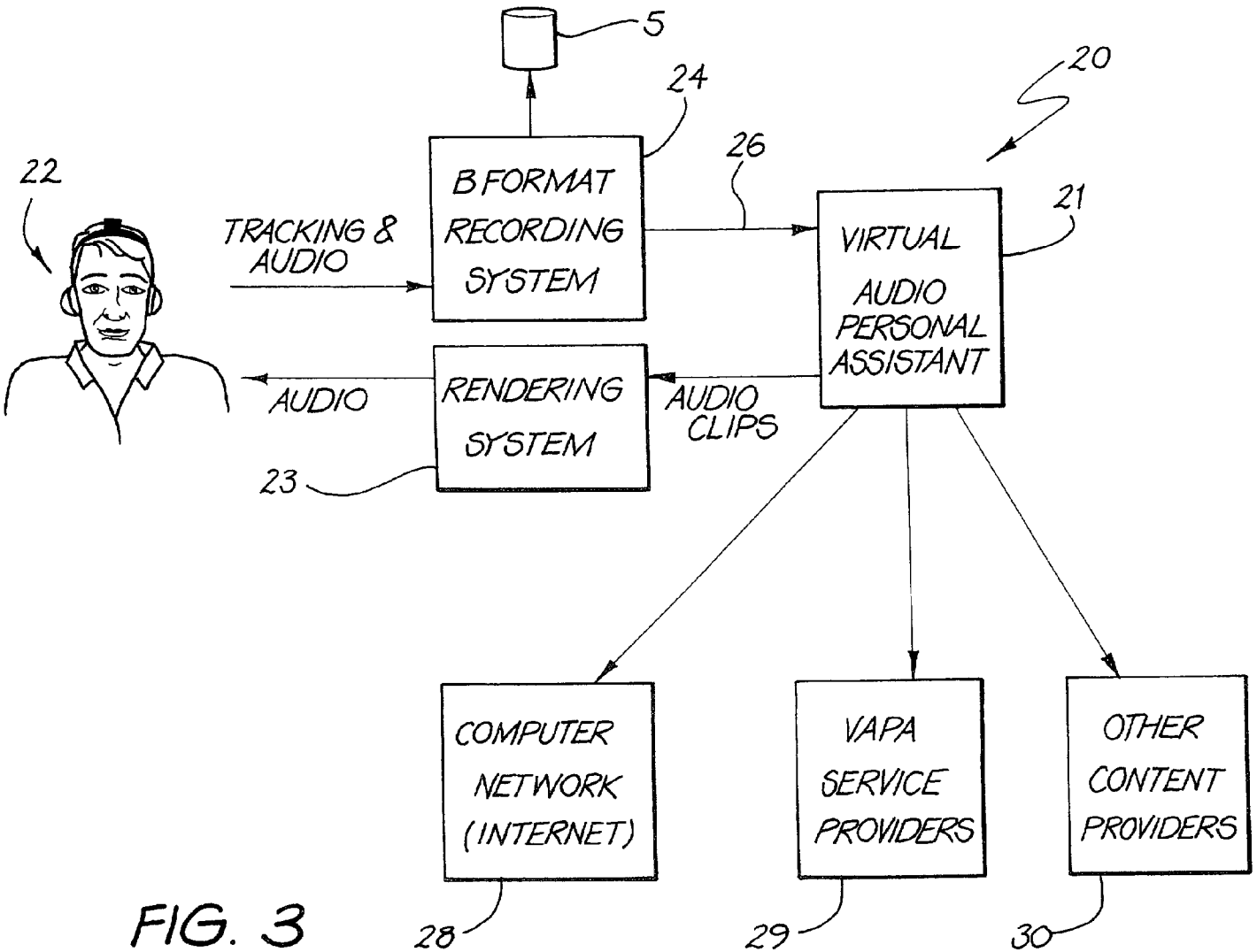
FIG. 3 illustrates a second embodiment of the present invention.

The ability to spatialize audio around a listener provides for the ability for more complex and useful arrangements to be created. In particular, various customizations of the arrangement of FIG. 2 are possible. For example, as illustrated in FIG. 3, there is illustrated schematically an alternative embodiment which includes the introduction of the concept of the utilisation of a virtual audio personal assistant (VAPA) 21 which provides a degree of customisation and localisation of information relating to the world view of a user 22. The user 22, utilizes the head tracked and audio spatialized system as before with audio being rendered by rendering system 23. Similarly, the audio system can include sound recording capabilities. Preferably, the sound recording capabilities are provided by B-format microphones which record spatialization characteristics of the audio or the like and the audio and associated tracking information is recorded 24 with portions stored for later analysis 25 before being passed 26 to the VAPA 21. The VAPA is interconnected to various networks such as the Internet 28, various service providers 29 and other content providers 30. The VAPA provides a customised view of the world customised for the listener 22.

Figure 4:
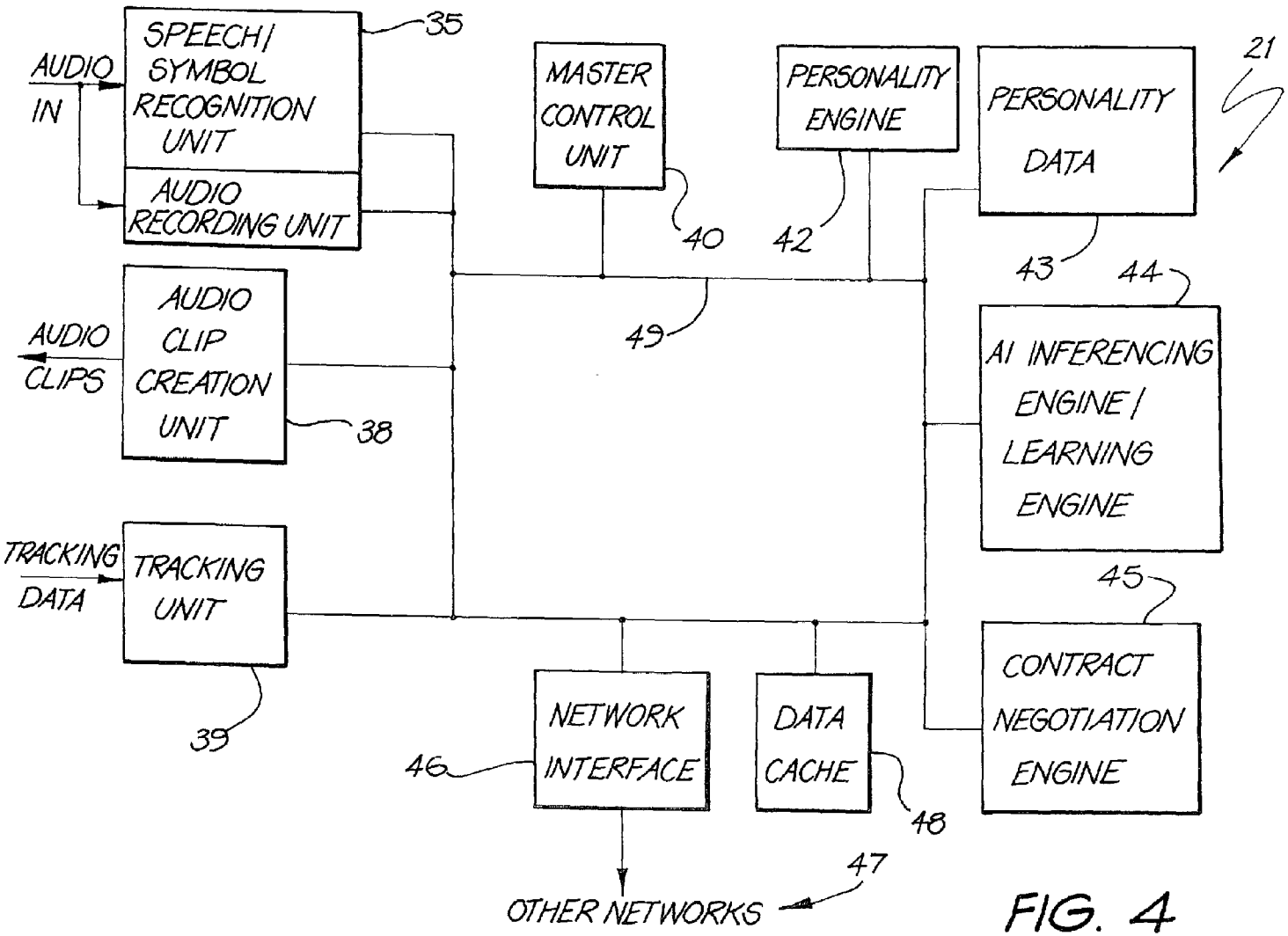
FIG. 4 illustrates one form of the VAPA of FIG. 3.

Turning now to FIG. 4 there is illustrated 1 schematically one form of implementation of the VAPA 21. Many other forms of implementation will be available to the person skilled in the art of programming and artificial intelligence techniques. The elements of FIG. 4 represent the core portions of one software design of the preferred embodiment which can contain the following components:

A speech and/or symbol recognition unit 35 which takes as an input the recorded audio stream from the user's environment and applies speech recognition techniques to determine the content of the speech around a listener, including decoding a user's speech. This unit can also determine audio gestures such as tongue clicks or the like of a listener so as to provide for interaction based on these audio gestures. Also, the audio can be itself recorded by audio recording unit 36.

An audio clip creation unit 38 is responsible for the creation of audio content having a relative spatial location relative to a listener. The audio clips are forwarded to rendering system 23 (FIG. 3) for rendering around a listener. The audio clip creation unit can include text to audio rendering and ideally renders the audio with associated spatialization information for location around a listener.

A tracking unit 39 accurately keeps and records the location and orientation of a listener's head.

A master control unit 40 is responsible for the overall control of the VAPA 21.

A personality engine 43 is responsible for providing various VAPA personalities to the user and interacts with a personality database 43 which stores customisation information of a user's interests and activities etc.

The system 21 can include various artificial intelligence inferencing engines and learning capabilities 44 which obviously are fully extendable and themselves evolvable over time with advances in AI type techniques.

A contract negotiation engine 45 is provided for the negotiating of transfer of information and carrying out of transactions across a network interface 46 which interfaces with external networks 47 in accordance with any regulatory framework that may be in place.

A data cache 48 is provided for storing frequently used data.

A network interface 46 for connecting with external Internet type networks.

Figure 5:
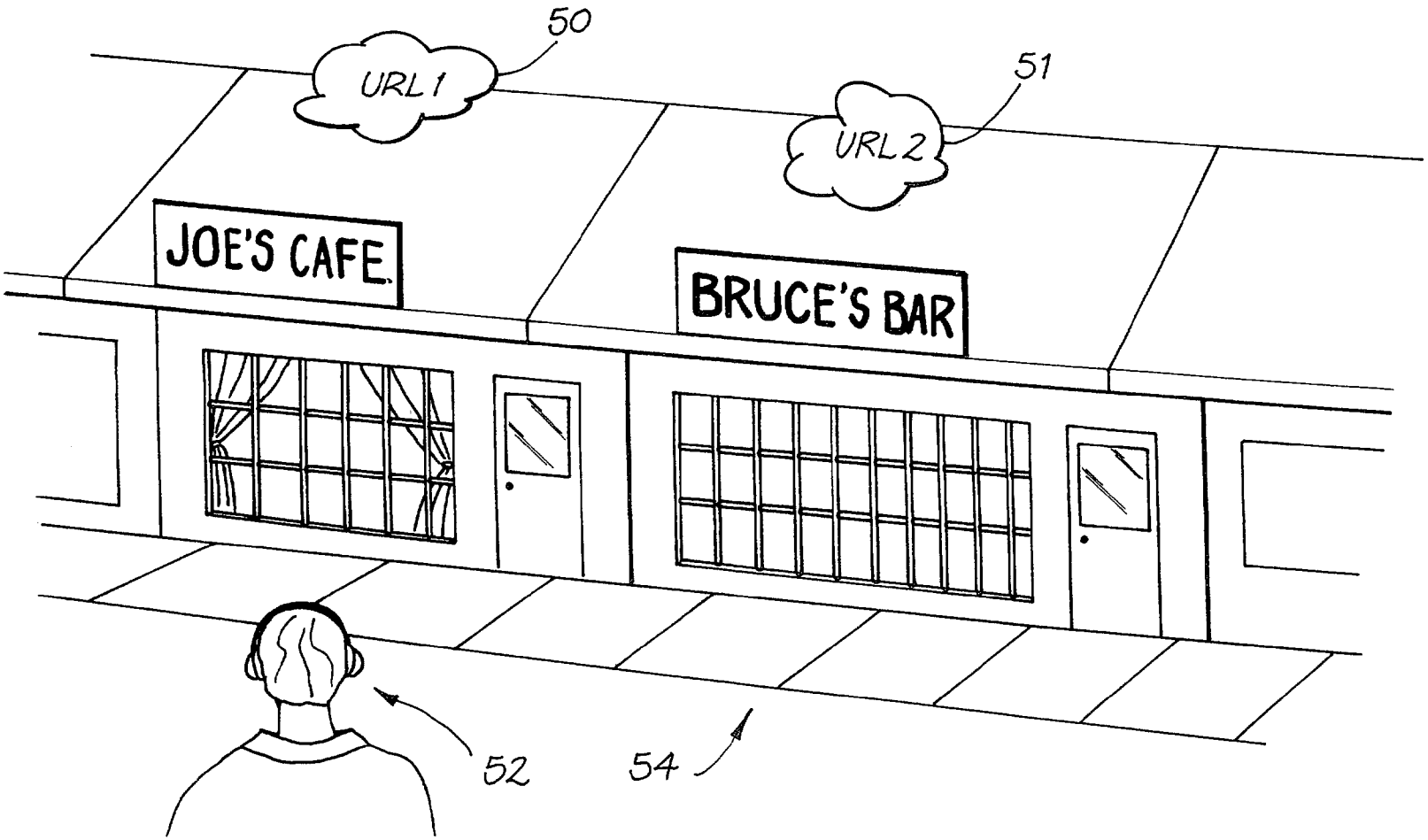
FIG. 5 illustrates schematically the process of mapping geographic URLs to spatial locations for use in an audio environment.

The units of the VAPA can be all interconnected 49 as necessary and can be implemented on a distributed computer architecture such as a clustered computer system so as to provide for significant computation resources. It will be obvious to those skilled in the art that other forms of the implementation of the VAPA are possible. Preferably, the VAPA operates in an environment which is rich in audio information. For example, one such environment can comprise an extension of the commonly utilised form of Universal Resource Locaters (URLs) which are commonly utilised on the World Wide Web as a data interfacing and exchange system. Ideally, in the preferred embodiment a URL system is provided which maps geographic locations of particularly unique URLs. An example is shown in FIG. 5 wherein an example is illustrated in which certain geographical locations such as cafes or the like have an associated geographic URL 50,51. A listener 52 utilizing the system is able to preferably access the URLs utilizing a standard interfacing technique such as producing a particular audio sound such as clicking a tongue or the like. Upon clicking a tongue, the current orientation of the listener's head is taken into account to access the URL eg 50 associated with the location 52. Upon the user requesting access to the URL, the VAPA accesses the associated URL over a computer network so as to download information associated to the URL.

In this manner, URLs are mapped to physical objects and individuals which are then capable of 'broadcasting' personal information, requests, laying trajectories et al. so as to provide a seamless integration of the experience of the sensory and the informatic realms. Dynamic objects such as people, planes, dogs and motor vehicles can be tracked by a variety of sensing systems. The URLs are then accessed so as to stream audio data via the relevant network server. Preferably allowing the users to both send and receive information.

It will be evident that objects are then able to provide a standard interface mechanism to indicate themselves, enter into negotiations and make transactions with the VAPA. A user is therefore able to select/query an object of interest (eye tracking, tongue click or other interface) causing the object to display its data—if this is a commercial object a transactional sequence might be negotiated, either by the user personally or by the VAPA on the users behalf. Mobile objects and people can be dynamically tracked and position located. In the case of an individual 'broadcasting' information, the VAPA can selectively screen the data and pass on items of interest to the user who might wish to enter into a direct conversation—alternatively the two individuals might electronically exchange data, and/or arrange an appointment etc.

Further refinements are possible. For example, ideally the VAPA can take on multiple persona's, representing various levels of intervention/management/information provision—ie from the informal and friendly to the strictly efficient. The VAPA can act also as a personal assistant, maintaining a diary, recognized the day's agenda, requesting advice on how to handle the user, and transacting with external bodies such as taxi companies or the like to order services giving the users URL (and destination and credit card number) which will allow the service provider to locate the user in physical space.

Depending on the environment and interfaces provided, the user may use non-verbal action (wink) or say tongue click to indicate object of inquiry and launch the various AI engines to search for combinations/links between data associated with physical sites, temporal data (news/stock exchange) and data stored as knowledge. The VAPA can then make an initial screening of the data and present the most pertinent elements.

Ideally, the keeping of personal information allows the system to remember what a user does each day and responds to the user's behaviour. In this way, the user can establish a complex set of profiles over time—for example work related interests, a network of contacts, frequently visited physical locations (restaurants, home, work) with which regular sets of activities are associated. Or new locations which are to be visited for which data is selected according to the user's anticipated requirements. Ideally, the system is able to records what a user hears for later retrieval and analysis.

Further, the VAPA can preferably modulate the volume of various sound sources depending on the orientation of a listener. The VAPA can also be capable of tagging audio input (or data input) to a physical location for later user.

An example utilization of the system is given in the following dialogue:

I haven't been in this city for a long time, it is evening and I have a few hours to kill before an appointment. It was a long flight, but after a couple of hours sleep and a shower I am ready to re-join the human race—to login again.

After dressing I carefully insert the studs of my VAPA (Virtual Audio Personal Assistant) through my earlobes and gently insert the miniature speaker conduits into my ear canals, a clear but voice responds to the almost inaudible double click of my tongue:

"Oh hello Nigel, we have arrived in Helsinki and it is 21.23, I presume you have slept well?"

"Uh huh"

"I have double checked your room bookings and all your appointments have confirmed, what are your requests for this evening?"

"Well this is Helsinki—how about you find me a good bar with Russian food, then arrange Tapio to meet me at the Meteori Bookstore at 23.00—guide me when I leave the building".

"Do you want a cab?"

No thanks—and just be pretty quiet this evening ok—only chat if it is important and would you turn off that local tourist background—it drives me nuts!"

I leave the hotel and adjust my astrakhan hat—ouch it's cold here, the VAPA assumes the laid-back 'Robert' persona, his voice over to my right beckons me, "Let's go this way—look ahead and you will see a large Theatre Building, take the first left after the main entrance and walk for about 150 meters". Standing at the Kerb I stare at the grey bulk of the National Theatre, I blink as a snowflake brushes my face and immediately the Theatre begins to announce its programme, with some surround sound musical extracts thrown in to entice me!

"Robert would you turn this thing off—look, I know I haven't been here for a long time but I want a quiet evening—so go easy on the hot-spots ok, maybe increase the threshold of my triggers to double-blink and triple tongue-click for a while!"

I walk through the light snow flurries in silence, Robert has suppressed all the normal weather data, stock exchange, voicemail etc and is doing a good job of filtering the commercial and historical information which to be sure every structure and surface in this city is capable of broadcasting.

Again his voice, some 15 meters ahead of me indicates that this is the bar. It sports a large red star with a Russian script, I rapidly blink my right eye, the bar swirls with sound and a bass Slavic voice welcomes me in heavily accented English—the bar is called "Zetor" named after a famous Russian tractor and . . . with a single click of the tongue I terminate my host midway through his recital of today's menu. Entering I take a place at the bar on a well sprung iron tractor seat and order a Vodka from the bartender, who as is normal winks twice at me and smiles.

He returns with the shot glass and two slices of dill pickle and in an apologetic tone asks if I want to settle in cash as my 'signature' is down. Realising that I am without cards or hard currency I quietly ask Robert to restore my URL signature to visibility and I nod congenially at the barman, who again winks twice at me (though without smiling this time).

Credit card details are logged and eventually the barman returns to strike up a casual conversation.

"Well it has been sometime since you were here Nigel—has the place changed much?"

"Not at all I reply" regretting that the Barman now knew who I was, what I did and if he cared to, could recall every drink I had ever ordered here—perhaps they even had some audio archives of these conversations! "Maybe you should re-do your virtual doorman out there—no-one speaks with those Uncle Vanya accents any more—or is it just a Finnish joke?"

In the background the music of 'Rinne-Radio' fills the room (well in a virtual manner) the bar has recognised my favourite Finnish band and has simulated the ambience on my behalf—but the big guy over in the corner tapping his feet at an incredible rate must be on some strange Nordic-Techno!

Robert discreetly pipes up again—unsure about my interest in the feral girl wearing a leather jacket down at the other end of the bar. Obviously she had 'blinked' me whilst Robert fixed up the credit card with the barman and decided that we has very similar interests, at least she had offered to by me a drink!

"She looks good on paper" offers Robert who closes with the somewhat rhetorical question "How is she in physical reality?"

I decide to take up the offer—but ask the VAPA to close down my signature for the while, after all the lady has already downloaded from my URL. As I walk over slowly I fix my gaze on the leather jacket and triple click my tongue, her general introduction begins to play out, set into a room ambience of chamber music (looks can be deceiving!) I perform a rapid eye movement to the left to access her credentials, name, nationality, profession, age and so on.

I was in the process of clicking off when I must have accidentally queried an object for instantly a man's rather elegant wool jacket reeled off a sophisticated sales routine and let me know that tomorrow the Stockmann department store had a 35% sale on men's wear. My signature was down so Stockmann's wouldn't be getting in touch with Robert to arrange a fitting as it lacked the necessary information concerning my preferred cut, fabric and colour—anyway when I travel I still like to do old fashioned window shopping! And now for some old fashioned conversation:

We exchange greetings and I thank Terhi for the drink. "Tell me more about the book you are writing I ask (although Robert has already given me the title) as you know this is my field of specialisation"

"Let me remember this conversation" she begins (indicating that her VAPA is audio archiving our meeting, logging its location and time—in addition it will be exchanging the data on our respective URL's and possibly searching for convenient future appointment times) "the book concerns the history of audio recording and its effects on concepts of human memory . . .".

The conversation is very convivial—the evening passes quickly and a reasonable amount of Vodka is imbibed. Eventually Robert takes on a slightly hectoring tone telling me that he has ordered a taxi to meet me as soon as I leave the building (which I am advised to do ASAP as I am running late).

Terhi and I arrange to meet the following week at a concert—her VAPA will liaise with mine about the exact arrangements—we take our leave. The barman says goodnight and as I pace down the snow covered street I hear a taxi tone playing some way behind me—I decide to keep walking ahead, simply to keep warm, the driver knows where I am anyhow.

Tapio's voice appears and tells me that I will be there in about three minutes so what kind of coffee would I like, coffee with Russian Vodka, or Coffee with Finnish Vodka?. . .

The above scenario is obviously indicative only of the type of functionality that can be provided.

Figure 6:
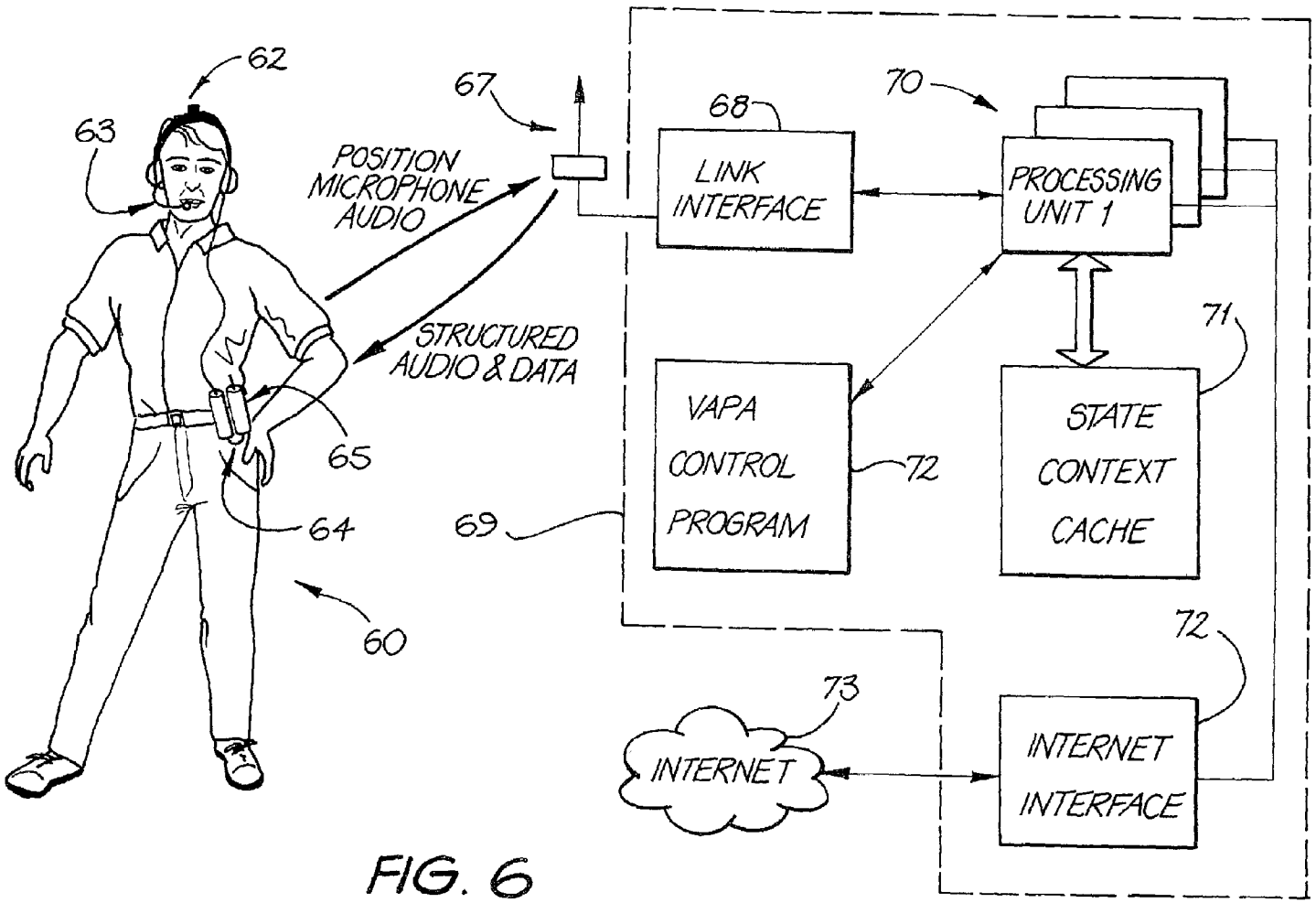
FIG. 6 illustrates an alternative embodiment of the present invention.

It will be evident to the person skilled in the art that other forms of implementation of embodiments of the invention are possible. One further alterative embodiment will now be discussed initially with reference to FIG. 6 which illustrates a schematic of the hardware portions of an alternative form of the embodiment. In this embodiment, a user 60 is equipped with a set of headphones 61 which include a position and orientation tracker 62. The position and orientation tracker can include magnetic compass or the like, in addition to GPS receiver technology. The headphones also include a microphone 63 and are attached to a processing unit for rendering audio spatially 64. The processing unit is in turn interconnected to a communications unit 65 which can comprise a mobile phone device or the like. The communications device 65 is in permanent connection with a base station 67 so as to transmit position information and microphone audio to the base station 67 and receive structured audio and text data or the like from the base station 67. The link can be driven by a communications interface 68 which acts like a modem transmission system. The execution portions 69 are provided in a base station. The base station includes a number of processing units 70 which provide processing capabilities for a number of different virtual audio personalities. The processing unit 70 interacts with a state context cache 71 and operates under the control of a master control program 72. The processing unit 70 are in turn interconnected with an Internet interface 72 which interacts with the Internet 73 so as to download information for forwarding to the user 60 in an audio format as previously described.

Figure 7:
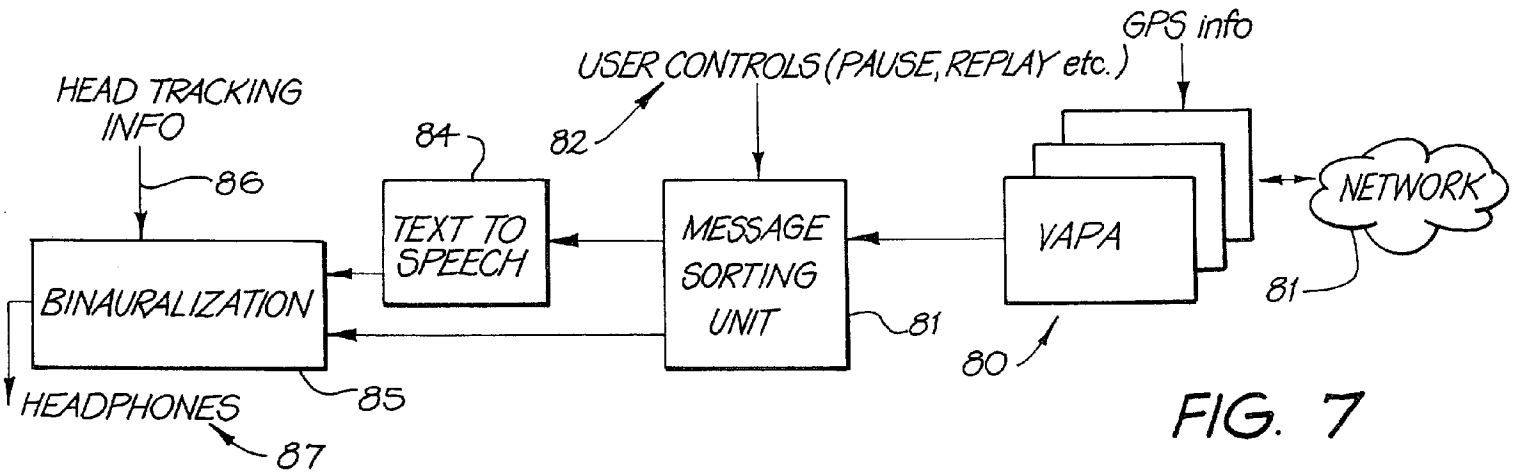
FIGS. 7 and 8 illustrate further alternative embodiments of the present invention.

Turning now to FIG. 7, there is illustrated a further schematic diagram of an alternative embodiment. The alternative embodiment includes a number of VAPAs 80 which each implement a different audio personality for a user. The VAPAs are interconnected to a network 81 which can comprise the Internet for accessing and downloading information on demand. Input to the VAPAs include position and orientation data associated with the user. The VAPAs output messages to a message sorting unit 81 which determines which messages shall be forwarded to the user depending upon a set of user controls 82 and other state data as previously set by the user. Messages can be in a text or audio format. A subset of the messages are output from the message sorting unit 81 with text messages being output to a text to speech processor 84. The audio data includes spatalization information and is output to a binauralization unit 85 which spatalizes the audio utilizing the head tracking information 86 for output to headphone devices 87.

Figure 8:
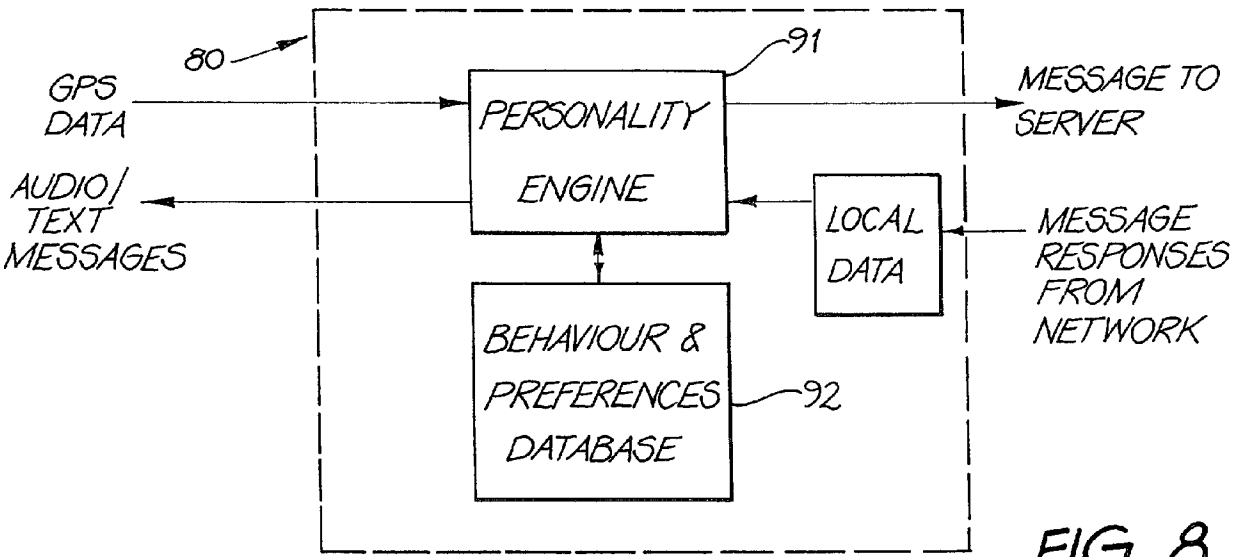

One form of VAPA unit 80 is illustrated in more detail in FIG. 8. Each VAPA can implement a separate personality and is operated by a personality engine 91 which interacts with a behaviour and preferences database 92. The database 92 can include details on behavioural characteristics of the VAPA including such factors as the voice characteristics of the VAPA, and its priority relative to the other VAPAs. Further, the preferences can include the kinds of things that the user is interested in, whether the VAPAs of other users near a current user should be told of the VAPAs presence, whether shops and social services etc should be told of the users presence in the vicinity, what kind of portals the VAPA will talk to.

The preferred embodiments also allow for a new type of portal (similar to those provided by the likes of Yahoo etc). The portals can contain information of say a series of shops selling a particular product in a predetermined area. The portals can include an accredited level of advertising and sharing of personal data and can further include specialist portals such as a specialist tour guides etc. The VAPA, as illustrated in FIG. 8, sends a series of messages to the relevant servers and receives a series of responses to each request. The responses are examined for suitability before being forwarded to the user. An example of message can, for example, be "my GPS Co-ordinates are x, y, z and I want to know about men's shoes". The response list might include entries of forms such as "GPS coordinate a, b, c includes Bill's Shoe Shop which has a special on Italian shoes for sale". In this manner, the VAPAs are able to converse with a world-wide-web type structure for providing information on demand and allowing the user to experience an augmented audio reality.

In various embodiments, the network can include various push advertising scenarios wherein the owner of a shop of the like pays a fee to make an announcement to a user in their vicinity of a shop sale or the like. The fee can be divided obviously between the providers of the network and the users in accordance with any agreed terms. Further, the user can provide a series of layered personal information facilities. In this manner, information can be revealed from one VAPA to a second VAPA depending upon the relationship between the corresponding users VAPAs. In this manner, VAPAs, are able to talk to one another and reveal information about their users depending upon the access level of the VAPA requesting information. The VAPAs in a sense can act as agent negotiators on behalf of their users, seeking an audio approval from their users when required.

Various billing arrangement can be provided depending on the level of service provided. Further, listeners may receive a portion of revenues for listening to advertisements in the system. Further, specialist tours could be provided with the implementers of the system negotiating with famous persons or the like to conduct an audio tour of their favourite place. For example "Elle McPherson's Tour of Dress Shops in Paddington" could be provided to be provided. The preferred embodiments obviously have extension to other areas such as military control systems or the like. Further, obviously multiple different VAPAs with different personalities can be presented to a user in an evolving system.

It will be understood that the invention disclosed and defined herein extends to all alternative combinations of two or more of the individual features mentioned or evident from the text or drawings. All of these different combinations constitute various alternative aspects of the invention. The foregoing describes embodiments of the present invention and modifications, obvious to those skilled in the art can be made thereto, without departing from the scope of the present invention.

What is claimed is:

1. A system for providing a listener with an augmented audio reality in a geographical environment, the system comprising:

a position locating system configured to determine a current position and orientation of a listener in the geographical environment, the geographical environment being a real environment at which one or more items of potential interest are located, each item of potential interest having an associated predetermined audio track;

an audio track retrieval system configured to retrieve for any one of the items of potential interest the audio track associated with the item and having a predetermined spatialization component dependent on the location of the item of potential interest associated with the audio track in the geographical environment;

an audio track rendering system adapted to render an input audio signal based on any one of the associated audio tracks to a series of speakers such that the listener experiences a sound that appears to emanate from the location of the item of potential interest to which is associated the audio track that the input audio signal is based on; and an audio track playback system interconnected to the position locating system and the audio track retrieval system arranged such that the system automatically ascertains using the current listener position and orientation, the spatial relationship between the listener and the items of potential interest, the playback system configured to automatically ascertain which audio track, if any, to automatically forward to the rendering system according to the ascertained relationship to the items of potential interest, and further configured to forward the ascertained audio tracks to the audio rendering system for rendering depending on the current position and orientation of the listener in the geographical environment and the ascertained relationship, such that the listener for any particular item of potential interest for which an audio track has been forwarded, has the sensation that the forwarded audio track associated with the particular item is emanating from the location in the geographical environment of the particular item of interest.

2. A system as claimed in claim 1 wherein said system is arranged, in use, to simultaneously provide an augmented audio reality to multiple listeners located in said geographical environment.

3. A system as recited in claim 1 or claim 2 wherein said speakers comprise a set of headphones.

4. A system as recited in claim 1 or claim 2, wherein the position locating system is arranged, in use, to determine the listener's head orientation as said current orientation of the listener in said geographical environment.

5. A system as recited in claim 1 or claim 2 wherein said geographical environment comprises one of tourism, outdoor sight seeing, a museum tour, a mobility aid for the blind and for industrial applications, artistic performances, Indoor Exhibition Spaces, Outdoor Exhibition spaces, Tours, Exhibition, City Tours, both guided and self-guided, Botanical Gardens, Zoos, Aquariums, Entertainment, Theme parks, Interactive theme environments, Construction, auditory display of data such as plans or existing structures below ground, and Architectural on-site walk throughs.

6. A method of providing a listener with an augmented audio reality in a geographical environment, the method comprising the steps of:

determining a current position and orientation of a listener in said geographical environment, the geographical environment being a real environment at which one or more items of potential interest are located, each item of potential interest having an associated predetermined audio track;

ascertaining using the current listener position and orientation, the spatial relationship between the listener and the items of potential interest ;

automatically ascertaining which audio track, if any, to automatically retrieve according to the ascertained relationship to the items of potential interest;

automatically retrieving the ascertained audio track having a predetermined spatialization component dependent on the location of the item of potential interest associated with the audio track in said geographical environment; and automatically rendering an audio signal based on the retrieved audio track associated with the item of potential interest, the rendering being to a series of speakers such that said listener experiences a sound corresponding to the retrieved associated audio track that appears to emanate from the location of the item of potential interest, wherein the rendering depends on said current position and orientation of said listener in said geographical environment, such that the listener for any item of potential interest for which an audio track has been retrieved, has the sensation that the retrieved audio track associated with the particular item is emanating from the location in the geographical environment of the particular item of interest.

7. A method as claimed in claim 6, wherein the method comprises simultaneously providing an augmented audio reality to multiple listeners located in said geographical environment.

8. A method as recited in claim 6 or claim 7 wherein said speakers comprise a set of headphones.

9. A method as recited in claim 6 or claim 7, wherein the method comprises determining the listener's head orientation as said current orientation of the listener in said geographical environment.

10. A method as recited in claim 6 or claim 7 wherein said geographical environment comprises one of tourism, outdoor sight seeing, a museum tour, a mobility aid for the blind and for industrial applications, artistic performances, Indoor Exhibition Spaces, Outdoor Exhibition spaces, Tours, Exhibition, City Tours, both guided and self-guided, Botanical Gardens, Zoos, Aquariums, Entertainment, Theme parks, Interactive theme environments, Construction, auditory display of data such as plans or existing structures below ground, and Architectural on-site walk throughs.

* * * * *